United States Patent [19]

Satake

[11] Patent Number: 4,645,590

[45] Date of Patent: Feb. 24, 1987

[54] VERTICAL TYPE SCREENING MACHINE FOR GRANULAR MATERIAL

[75] Inventor: Toshihiko Satake, Higashihiroshima, Japan

[73] Assignee: Satake Engineering Co., Ltd., Tokyo, Japan

[21] Appl. No.: 746,288

[22] Filed: Jun. 19, 1985

[30] Foreign Application Priority Data

Dec. 11, 1984 [JP] Japan ..... 59-262517

[51] Int. Cl.[4] ..... B07B 1/26

[52] U.S. Cl. ..... 209/304; 209/263; 209/261; 99/608

[58] Field of Search ..... 209/273, 270, 261, 262, 209/303-306, 241, 254, 283, 279, 280, 281, 293, 296, 263, 264; 99/574, 603-608, 246, 280

[56] References Cited

U.S. PATENT DOCUMENTS

| | | | |
|---|---|---|---|
| 263,564 | 8/1882 | Nielsen | 209/306 |
| 316,574 | 6/1885 | Gathmann | 209/306 |
| 745,743 | 12/1903 | Thayer | 209/296 |
| 833,617 | 10/1906 | Moore | 209/296 |
| 918,912 | 4/1909 | Rich | 209/303 |
| 1,624,831 | 4/1927 | Geddes | 99/603 |
| 3,062,375 | 11/1962 | Palm | 209/303 |

FOREIGN PATENT DOCUMENTS

| | | | |
|---|---|---|---|
| 147588 | of 1903 | Fed. Rep. of Germany | 209/306 |
| 159583 | 10/1982 | Japan . | |
| 34534 | 2/1911 | Sweden | 209/273 |
| 336262 | 11/1930 | United Kingdom . | |
| 823357 | 11/1959 | United Kingdom | 209/296 |

*Primary Examiner*—Kenneth M. Schor
*Assistant Examiner*—Thomas M. Lithgow
*Attorney, Agent, or Firm*—Henry Sternberg; Bert J. Lewen

[57] ABSTRACT

A vertical type screening machine for granular material comprises a housing. A rotary drum assembly is rotatably mounted within the housing and comprises a drum having a substantially vertical rotary axis and a helical blade helically wound around a circumferential surface of the drum. A cylindrical screen member disposed between the drum assembly and the housing cooperates with a peripheral wall of the housing to define therebetween a first chamber and cooperates with the circumferential surface of the drum to define therebetween a second chamber. The granular material to be screened is introduced into the top of the second chamber. Upon the rotation of the drum assemby, the granular material introduced into the top of the second chamber is moved toward the bottom of the second chamber by the helical blade and due to gravity. During the movement of the granular material toward the bottom of the second chamber upon the rotation of the rotary drum assembly, the granular material is subjected to a centrifugal force by the helical blade so as to be moved radially outwardly toward the screen member so that granular material having a relatively small size contained in the introduced granular material is introduced into the first chamber through the screen member. The remaining granular material within the second chamber is discharged from the bottom of the second chamber.

23 Claims, 9 Drawing Figures

142
151
146
141
140
26
147
51
148
143
147
43
47
145
49
46
27
44
27
45
48
23
11
10
152
21
22
28
40
20
42
41
128
59
54
122
129
24
52
77
76
74
25
131
55
58
83
119
75
82
76
68
69
53
74
78
57
75
79
127
69
81
62
57
71
72
56
65
61
103
65
118
60
104
126
125
64
96
117
132
67
63
93
121
84
116
105
108
111
112
113
109
102
107
106
115
66
155
91
101
90
100
92

VERTICAL TYPE SCREENING MACHINE FOR GRANULAR MATERIAL

BACKGROUND OF THE INVENTION

The present invention relates to a vertical type screening machine for granular material such as, for example, cereal grain (rice, wheat, soybean or the like), granular ore, granular industrial products, and the like.

Japanese Patent Laid-Open No. 57-159583 laid open to public inspection on Oct. 1, 1982 discloses a vertical type screening machine for granular material, which includes a housing and a rotary drum assembly rotatably mounted within the housing. The rotary drum assembly includes a drum having a vertical rotary axis and a helical blade helically wound around a circumferential surface of the drum and secured thereto. A cylindrical screen member is disposed between the housing and the drum assembly in concentric relation to the drum. The screen member cooperates with a peripheral wall of the housing to define therebetween a first chamber and cooperates with the circumferential surface of the drum to define therebetween a second chamber. A supply hopper comunicates with a bottom of the second chamber, allowing granular material to be screened, to be supplied into the second chamber. The helical blade is wound around the circumferential surface of the drum in such a direction as to allow the granular material fed to the bottom of the second chamber to be moved toward a top of the second chamber against gravity when the rotary drum assembly is drivingly rotated. When the granular material is moved from the bottom to the top of the second chamber by the rotation of the rotary drum assembly, the graunular material is moved radially outwardly toward the screen member by the rotary drum assembly, and granular material having a relatively small size contained in the supplied granular material is introduced into the first chamber through the screen member. The granular material of relatively small size within the first chamber is discharged from the bottom of the first chamber. The remaining graunular material within the second chamber is discharged from the top of the second chamber.

As described above, in the conventional vertical type screening machine, the granular material supplied into the bottom of the second chamber is moved from the bottom to the top of the second chamber against gravity by the helical blade secured to the drum upon the rotation thereof. This causes such a problem that the movement of the graunular material against gravity inevitably increases a power required to drivingly rotate the rotary drum assembly, to thereby decrease working efficiency of the machine and such a problem the the granular material would be damaged because the granular material urged against the screen member is forcibly pushed upwardly by the helical blade.

In addition, in the above-described vertical type screening machine of the prior art, as an amount of the granular material supplied into the bottom of the second chamber is decreased, a thickness of the granular material layer on an upper surface of the helical blade is decreased, and a pressure of the granular material layer acting on the upper surface of the helical blade is decreased, so that a centrifugal force acting on the granular material due to the frictional contact force of the granular material against the upper surface of the helical blade is decreased to reduce screening efficiency and screening accuracy.

OBJECTS AND SUMMARY OF THE INVENTION

An object of the present invention is to provide a vertical type screening machine for granular material, which is capable of reducing a power required to drive the machine, thereby increasing working efficiency.

Another object of the present invention is to provide a vertical type screening machine for granular material, which is capable of coping with a change in the amount of the granular material to be screened, to thereby provide stable screening efficiency and screening accuracy.

Still another object of the invention is to provide a vertical type screening machine for granular material, in which a fluidity of the granular material on a helical blade is activated, thereby making the screening work efficient.

According to the present invention, there is provided a vertical type screening machine for granular material, comprising: a housing having a peripheral wall; a rotary drum assembly rotatably mounted within the housing, the drum assembly including a drum having a cylindrical circumferential surface and having a substantially vertical rotary axis, and a helical blade helically wound around the circumferential surface of the drum and secured thereto; cylindrical screen means disposed between the housing and the rotary drum assembly in substantially concentric relation to the drum, the screen means cooperating with the peripheral wall of the housing to define therebetween a first chamber and cooperating with the cylindrical circumferential surface of the drum to define therebetween a second chamber; means communicating with a top of the second chamber for allowing granular material to be screened, to be supplied into the second chamber; drive means drivingly connected to the rotary drum assembly for rotating the same to move the granular material supplied into the second chamber, radially outwardly toward the screen means, to thereby allow granular material having a relatively small size contained in the granular material to be screened, to be introduced into the first chamber through the screen means; the helical blade being helically wound around the circumferential surface of the drum in such direction as to allow the granular material supplied into the second chamber to be moved toward a bottom of the second chamber due to gravity when the rotary drum assembly is rotated by the drive means; first outlet means communicating with a bottom of the first chamber for allowing the granular material of relatively small size to be discharge out of the first chamber; and second outlet means communicating with the bottom of the second chamber for allowing the remianing granular material within the second chamber to be discharged therefrom.

According to the present invention, there is further provided a vertical type screening machine for granular material, comprising: a housing having a peripheral wall; a rotary drum assembly rotatably mounted within the housing, the drum assembly including a drum having a cylindrical circumferential surface and having a substantially vertical rotary axis, and a helical blade helically wound around the circumferential surface of the drum and secured thereto; cylindrical screen means disposed between the housing and the rotary drum assembly in substantially concentric relation to the drum, the screen means cooperating with the peripheral wall of the housing to define therebetween a first chamber and cooperating with the cylindrical circumferential surface of the drum to define therebetween a second chamber; inlet means communicating with the second chamber for allowing granular material to be screened, to be supplied into the second chamber; drive means drivingly connected to the rotary drum assembly for rotating the same to move the granular material supplied into the second chamber, radially outwardly toward the screen means, to thereby allow granular material having a relatively small size contained in the granular material to be screened, to be introduced into the first chamber through the screen means; first outlet means communicating with the first chamber for allowing the granular material of relatively small size to be discharged out of the first chamber; second outlet means communicating with the second chamber for allowing the remaining granular material within the second chamber to be discharged therefromp; and the helical blade having an upper surface thereof which is stepped so as to have at least one riser surface portion and adjacent radially outward and inward tread surface portions connected to each other in a contiguous manner by the riser surface portion, in cross-section in a plane including the rotary axis of the drum, the radially outward tread surface portion being located below the radially inward tread surface portion.

DETAILED DESCRIPTION OF THE PREFERRED EMBODIMENTS

Figure 1:
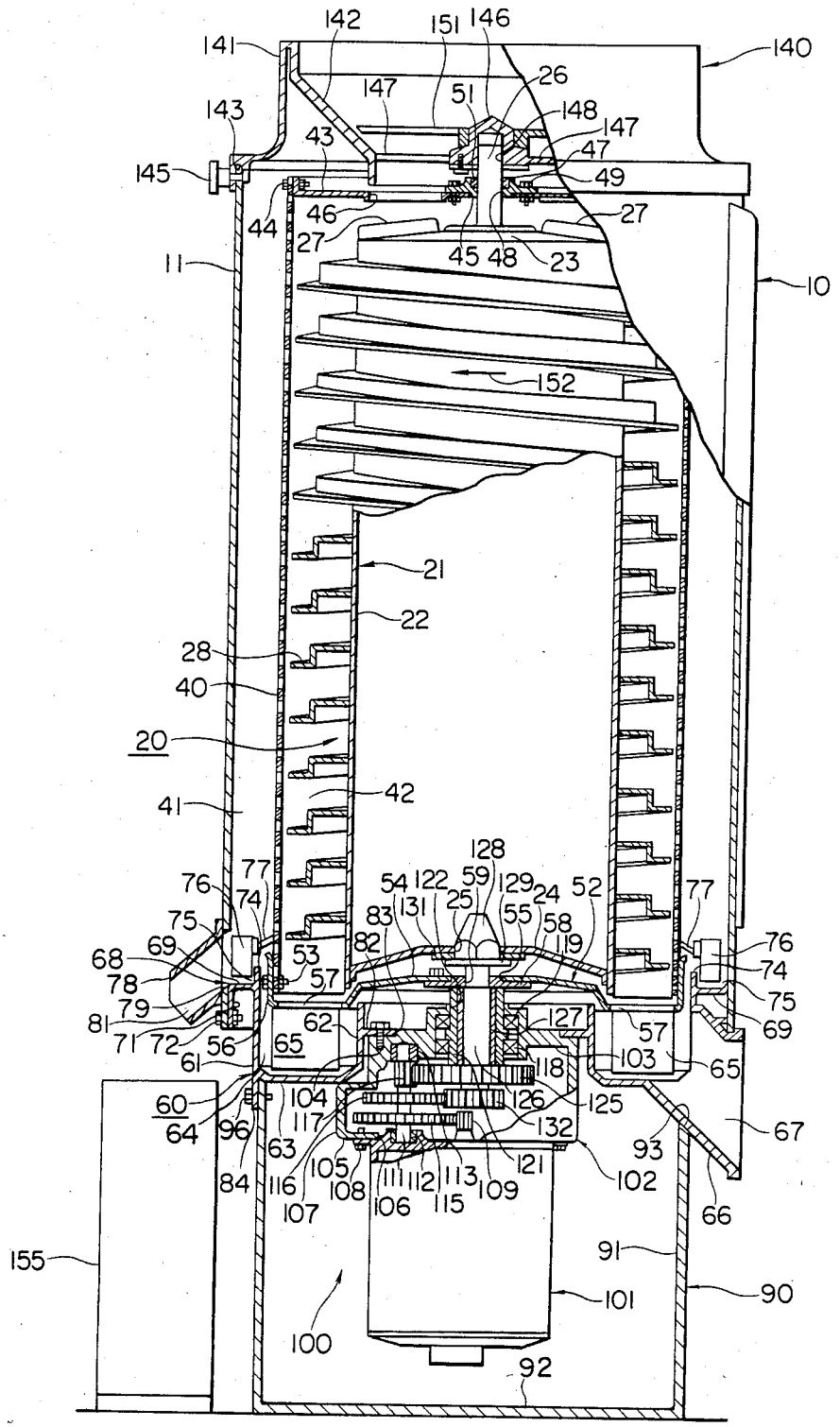
FIG. 1 is a partially broken-away, front elevational view showin a vertical type screening machine for granular material in accordance with an embodiment of the invention.

Referring now to FIG. 1, a vertical type screening machine for granular material in accordance with an embodiment of the invention includes a housing, generally designated by the reference numeral 10, which has a peripheral wall 11 having an any desirable crosssectional shape and having an open top end and an open bottom end.

A rotary drum assembly, generally designated by the reference numeral 20, is rotatably mounted within the housing 10 and includes a drum 21 having a substantially vertical rotary axis. The drum 21 has a cylindrical wall 22 having an upper open end and a lower open end, an upper end wall 23 secured to the upper open end of the cylindrical wall 22 so as to close the upper open end, and a lower end wall 24 having formed therein a rectangular central opening 25 and secured to the lower open end of the cylindrical wall 22 so as to substantially close the lower open end. A support shaft 26 is secured to the upper end wall 23 so as to extend upwardly from a center thereof. A pluralty of radially extending distributing blades 27 are secured to an upper surface of the upper end wall 23 in circumferentially equidistantly spaced relation to each other. In addition, a helical blade 28 is helically wound around the circumferential wall 22 of the drum 21 and is secured to an outer surface of the circumferential wall 22.

Figure 2:
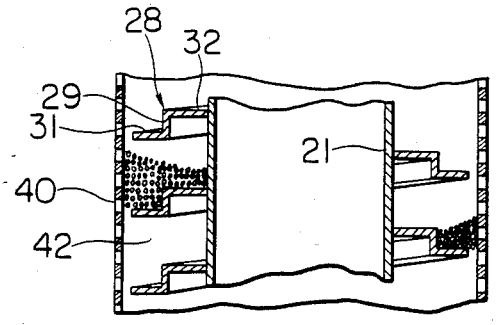
FIG. 2 is an enlarged fragmental cross-sectional view of the screening machine shown in FIG. 1.

As best shown in FIG. 2, the helical blade 28 has an upper surface thereof which is stepped so as to have at least one (one in the embodiment shown) riser surface portion 29 extending substantially vertically and adjacent radially outward and inward tread surface portions 31 and 32 which are connected to each other in a contiguous manner by the riser surface portion 29, in cross-section including the rotary axis of the drum 21. The radially outward tread surface portion 31 is located below the radially inward tread surface portion 31. The tread surface portions 31 and 32 extend substantially horizontally.

Referring again to FIG. 1, a cylindrical screen member 40 having a suitably selected mesh is disposed between the peripheral wall 11 of the housing 10 and the rotary drum assembly 20 in substantially concentric relation to the drum 21. The screen member 40 cooperates with the peripheral wall 11 of the housing 10 to define therebetween a first chamber 41 and cooperates with the circumferential wall 22 of the drum 21 to define therebetween a second chamber 42. An upper end plate 43 mounted on an upper open end of the screen member 40 by bolt and nut assemblies 44 is formed with a central opening 45 and a plurality of circular openings 46 equidistantly spaced around the central opening A hub member 47 having therein a central bore 48 is received in the central opening 45 of the upper end plate 43 and is mounted on the upper end plate 43 by bolt and nut assemblies 49. The support shaft 26 of the rotary drum assembly 20 extends through the bore 48 in the hub member 47 with a bearing bush 51 being disposed between the hub member 47 and the support shaft 26, to thereby rotatably support the screen member 40. A lower end plate 52 mounted on a lower open end of the screen member 40 by bolt and nut assemblies 53 comprises a central circular portion 54 having therein a central opening 55, radially outward vertical rim portion 56, and a plurality of circumferentally spaced radial arm 57 connecting the circular portion 54 and the rim portion 56 to each other in an integral manner. Each pair of adjacent arms 57 define therebetween an opening. A disc 58 having therein a central opening 59 is received in the central opening 55 in the lower end plate 52 and is mounted on the central circular portion 54 of the lower end plate 52 by means of bolts.

An integral annular channel member, generally designated by the reference numeral 60, comprises a radially outward peripheral wall 61, a radially inward peripheral wall 62 and an annular bottom wall 63 extending between the peripheral walls 61 and 62 to define an annular channel 64. A plurality of radial scaping blades 65 are disposed within the annular channel 64 in circumferentially equdistantly spaced relation. The upper ends of the respective scraping blades 65 are respectively secured to the arms 57 of the lower end plate 52 which is attached to the lower open end of the screen member 40. The annular channel 64 is vertically aligned with the second chamber 42 and communicates with the bottom of the second chamber 42 through the openings defined between the arms 57 of the lower end plate 52. A duct portion 66 which extends radially outwardly and downwardly defines a discharge outlet 67 which communicates with the second chamber 42 through the annular channel 64. A flange 68 comprises an annular horizontal wall portion 69 extending radially outwardly from the radially outward peripheral wall 61 of the channel member 60 and a substantially annular depending wall portion 71 extending vertically downwardly from the horizontal wall portion 69. The depending wall portion 71 is attached to the lower end of the peripheral wall 11 of the housing 10 by bolt and nut assemblies 72. An annular wall portion 74 extending upwardly from a top end of the radially outward peripheral wall 61 cooperates with the horizontal wall portion 69 and a portion, facing to the annular wall portion 74, of the peripheral wall 11 of the housing 10 to define an annular channel 75 which forms the bottom of the first chamber 41. A plurality of scraping blades 76 are disposed within the annular channel 75 in circumferentially equidistantly spaced relation and are fixedly connected to the screen member 40 by respective arms 77. A short duct 78 defines a discharge outlet 81 communicating with the first chamber 41 through an opening 79 formed in the lower end portion of the peripeheral wall 11 of the housing and through the annular channel 75. A horizontal annular flange 82 extends radially inwardly from the radially inward peripheral wall 62 to define a circular opening 83. A vertical arcuate flange 84 extends vertically downwardly from the bottom end of the radially outward peripheral wall 61.

A base structure, generally designated by the reference numeral 90, comprises a cylindrical peripheral wall 91 and a bottom wall 92 closing a lower open end of the peripheral wall 91. An upper end of the peripheral wall 91 is provided with a cut-out 93 for receiving therein the duct portion 66 of the channel member 60. The upper end of the peripheral wall 91 abuts against the annular bottom wall 63 of the channel member 60 to support the same and is attached to the flange 84 of the channel member 60 by means of bolts 96.

A drive nut, generally designated by the reference numeral 100, comprises an electrical motor 101 and a gear box 102. The gear box 102 has an integral gear case which comprises a top wall 103 received in the opening defined by the flange 82 and mounted thereon by bolts 104, a bottom wall 105 having therein a central opening 106, and a peripheral wall 107 extending between the top and bottom walls 103 and 105. An end wall of the motor 101 is received in the opening 106 in the bottom wall 105 of the gear case and is mounted on the bottom wall 105 by bolts 108 so that an output shaft 109 extends into the gear case. A counter shaft 111 has a lower end therof rotatably received in a circular recess in the end wall of the motor 101 through a bearing bush 112, and an upper end rotatably received in a circular recess in the top wall 103 of the gear case through a bearing bush 112. A large diameter gear 115 is mounted on the counter shaft 111 for rotation therewith and is in mesh with gear teeth formed on the output shaft 109 of the motor 101. An intermediate diameter gear 116 and a small diameter gear 117 are also mounted on the counter shaft 111 for rotation therewith. The top wall 103 of the gear case has an integral cupshaped portion within which two ball bearings 118 and 119 are received. A hollow drive shaft 121 extends through an opening 122 formed in a bottom wall of the cup-shaped portion and is rotatably supported by the bearings 118 and 119. The hollow drive shaft 121 has an axial upper end thereof which is secured to the disc 58 fixed to the lower end plate 52 mounted on the lower open end of the screen member 40, and an axial lower end on which a large diameter gear 125 is mounted is rotation therewith. An axial lower end face of the hollow drive shaft 121 is substantially in flush with a lower surface of the large diameter gear 125 which is in mesh with the small diameter gear 117 on the counter shaft 111. A solid drive shaft 126 extends within the hollow drive shaft 121 with a bearing bush 127 being disposed between the solid drive shaft 126 and the hollow drive shaft 121. The solid drive shaft 126 extends upwardly beyond the axial upper end of the solid drive shaft 121 through the central opening 59 in the disc 58 and has a head 128 of rectangular cross-sectional shape fitted in the rectangular central opening 25 in the lower end wall 24 of the drum 21. A circular retainer 129 fixed to the solid drive shaft 126 supports the lower end wall 24 of the drum 21 with a disc 131 being positioned between the lower end wall 24 and the retainer 129. The solid drive shaft 126 has an axial lower end thereof extending from the axial lower end of the hollow drive shaft 121, and an intermediate diameter gear 132 is mounted on the extending end of the solid drive shaft 126 for rotatation therewith. The intermediate diameter gear 132 is in mesh with the intermediate diameter gear 116 on the counter shaft 111.

A supply hopper, generally designated by the reference numeral 140, has a radially outward peripheral wall 141 and a radially inward peripheral wall 142 converging downwardly. An upper end of the outward peripheral wall 141 and an upper end of the inward peripheral wall 142 are integrally connected with each other. The outward peripheral wall 141 is provided in its lower end with an annular groove 143 in which the upper end of the peripheral wall 11 of the housing 10 is received. Fasteners 145 (only one shown in FIG. 1) each movable between a lock position and an unlock position are provided to detachably mount the hopper 140 on the peripheral wall 11 of the housing 10. The hopper 140 further includes a central hub portion 146 and a plurality of circumferentially equidistantly spaced radial arms 147 integrally extending between the hub portion 146 and the inward peripheral wal 142. Each pair of adjacent arms 147 define therebetween an opening, and the hopper 140 communicates with the second chamber 42 through the openings defined between the arms 147 and the circular openings 46 in the upper end plate 43 attched to the upper open end of the screen member 40, to thereby form inlet means for the granular material to be screened. The central hub portion 146 is provided therein with a blind bore 148 to rotatably receive the upper end of the support shaft 26. An angularly movable shutter 151 for manually adjusting the areas of the respective openigns defined between the arms 147 is rotatably mountd on the hub portion 146.

In operation, granular material such as, for example, cereal grain (rice, wheat, soybean or the like), granular ore and graunlar industrial products is fed to the supply hopper 140. The motor 101 is energized. A rotational torque of the motor 101 is transmitted to the rotary drum assembly 20 through the output shaft 109, the large diamter gear 115, the counter shaft 111, the intermediate diameter gear 116, the intermediate diameter gear 132 and the solid drive shaft 126, thereby rotating the drum assembly 20 in the direction indicated by an arrow 152 in FIG. 1. Also, the rotational torque of the motor 101 is transmitted to the screen member 40 through the output shaft 109, the large diameter gear 115, the counter shaft 111, the small diameter gear 117, the large diameter gear 125 and the hollow drive shaft 121, thereby rotating the screen member 40 in the same direction as that of the drum assembly 20 but at a lower rotational speed than that of the drum assembly 20. The annularly movable shutter 151 is manually angularly moved to open the openings between the arms 147, allowing the granular material to be screened, to be introduced from the supply hopper 140 into the second chamber 42 through the openings between the arms 147 and through the circular openings 46. The granular material introduced into the second chamber 42 forms a granular material layer on the upper surface of the helical blade 28. The helical blade 28 is helically wound around the circumferential wall 22 of the drum 21 in such direction as to allow the granular material supplied into the second chamber 42 to be moved toward the bottom of the second chamber 42 due to gravity when the rotary drum assembly 20 is rotated by the motor 101 in the direction indicated by the arrow 152. The granular material is subjected to a centrifugal force due to a frictional contact of the granular material with the upper surface of the helical blade 28 having radially outward and inward tread surface portions 31 and 32 and the riser surface portion 29 so that the granular material is moved radially outwardly toward the screen member 40. By the radially outward movement, granular material having a relatively small size (e.g., broken grain, immature grain and dead grain in case of cereal grain) contained in the granular material to be screened is discharged into the first chamber 41 through the mesh of the screen member 40 and descends into the annular channel 75 within the first chamber 41. The granular material of realtively small size in the annular channel 75 is discharged through the discharge outlet 81 by the scraping blades 76 rotating together with the screen member 40 and is received in a container 155.

The granular material to be screened, introduced into the second chamber 42 is, as mentioned before, subjected to the centrifugal force by the helical blade 28 secured to the drum 22 upon the rotation thereof and is moved radially outwardly. When the radially outwardly moved granular material is brought into contact with the screen member 40 rotating at a lower rotational speed than that of the rotary drum assembly 20, the moving velocity of the granular material in the same direction as the rotational direction 152 of the drum 21 is reduced. Also, since the granular material is always subjected to gravity, the granular material is substantially helically moved downwardly in the same direction as the rotatonal direction 152 of the drum 21 at the lower speed than the rotational speed of the drum 21. The reduction in the moving speed of the granular material due to the contact thereof with the screen member 40 causes the granular material to be agitated on the upper surface of the helical blade 28 to ensure that the individual grains of the granular material are successively brought into contact with the upper surface of the helical blade 28.

The remaining granular material (i.e., regular grains in case of cereal grains) on the helical blade 28 is moved downwardly by the rotation of the rotary drum asesmbly 20 and is introduced into the annular channel 64. The remaining granular material within the annular channel 64 is discharged from the discharged outlet 67 by the scraping blades 65 rotating together with the screen member 40 and is transferred to a desired location by suitable conveying means (not shown).

A case where an amount of the granular material to be screened introduced frm the supply hopper 140 into the second chamber 42 changes will now be explained with reference to FIG. 2. As shown on the left side in FIG. 2, if the flow rate of the granular material to be screened from the supply hopper 140 to the second chamber 42 is at a regular or normal level, the granular material layer on the upper surface of the helical balde 28 extends in a mass state also onto the radially inward tread surface portion 32. The granular material layer extending in the mass state over the entire length of the upper surface of the helical blade 28 is subjected to a suitable centrifugal force by the frictional contact of the material with the radially outward and inward tread surface portions 31 and 32 and is effectively moved radially outwardly. In addition, as shown on the right side in FIG. 2, if the flow rate of the granular material to be screened from the supply hopper 140 to the second chamber 42 is decreased, the granular material mainly forms a layer in a mass state on the radially outward tread surface portion 31. The mass-state granular material layer formed on the radially outward tread surface portion 31 is subjected to a suitable centrifugal force by the frictional contact of the material with the radially outward tread surface portion 31 and is effectively moved radially outwardly. Thus, the mass-state granular material layer on the helical blade 28 is subjected to a suitable centrifugal force even if the thickness of the granular material layer changes, so that the screening work is stabilized with high screening performance and efficiency.

FIGS. 3 through 8 of the accompanying drawings show a vertical type screening machine for granular material in accordance with a further embodiment of the present invention, which comprises agitating means for rendering positive or ensuring an agitating action of the granular material to be screened on the helical blade. In FIGS. 3 through 8, components and parts like those of the embodiment shown in FIGS. 1 and 2 are designated by the like reference numerals and the explanation of the like components and parts will be omitted for the sake of simplification.

Figure 3:
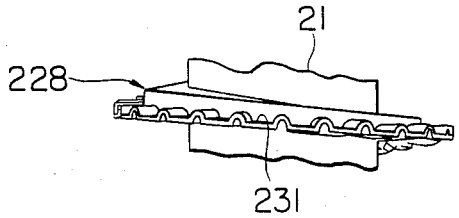
FIG. 3 is a fragmental view showing another embodiment of the invention having agitating means provided on an upper surface of a helical blade.

Referring to FIG. 3, the above-described agitating means comprises a radially outward tread surface portion 231 of an upper surface of a helical blade 228, which radially outward tread surface portion 231 is corrugated along the helical blade 228.

Figure 4:
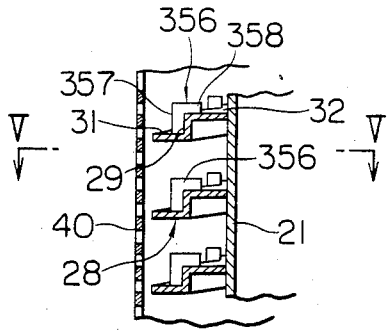
FIG. 4 is a fragmental cross-sectional view showing a modification of the agitating means provided on the upper surface of the helical blade.
Figure 5:
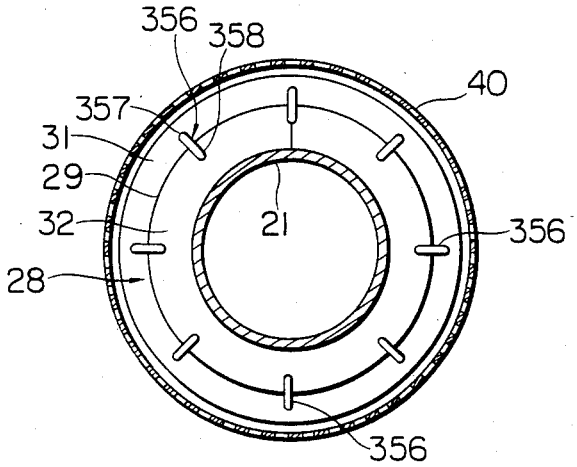
FIG. 5 is a cross-sectional view taken along the line V—V of FIG. 4.

Referring to FIGS. 4 and 5, the agitating means comprises a plurality of agitating blades 356 equidistantly spaced from each other along the helical blade 28 and secured to the upper surface thereof. As shown in FIG. 4, each of the agitating blades 356 has a radially outward section 357 extending upwardly from an area, adjacent to the riser surface portion 29, of the radially outward tread surface portion 31 of the upper surface of the helical blade 28 beyond the radially inward tread surface portion 32 along the riser surface portion 29, and a radially inward section 358 extending upwardly from an area, adjacent to the riser surface portion 29, of the radially inward tread surface portion 32 and integrally connected to the radially outward section 357.

Figure 6:
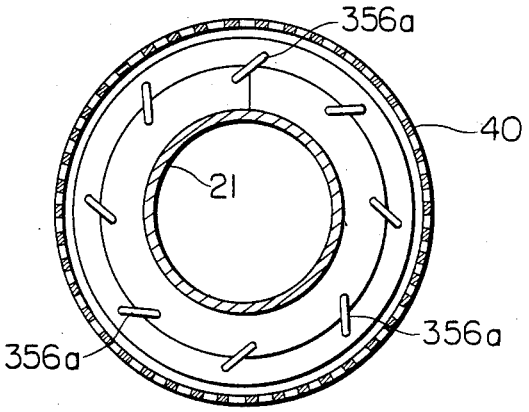
FIG. 6 is a cross-sectional view similar to FIG. 5, but showing inclined agitating vanes.
Figure 7:
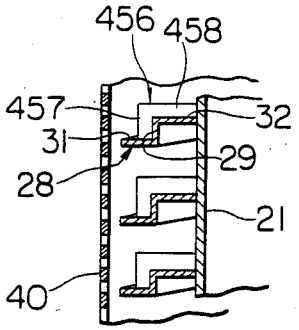
FIG. 7 is a fragmental cross-sectional view showing a modification of the agitating vanes shown in FIG. 4.
Figure 8:
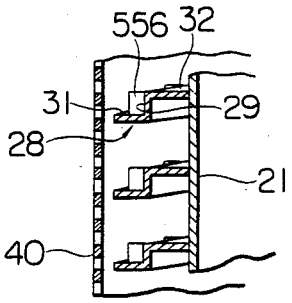
FIG. 8 is a fragmental cross-sectional view showing another modification of the agitating vanes shown in FIG. 4.

The respective top ends of the radially outward and inward sections 357 and 358 of each agitating blade 356 are in flush with each other. As shown in FIG. 5, each of the agitating blades 356 is disposed in a plane including the vertical rotary axis of the drum 21. As shown in FIG. 6, however, each agitating blade 356*a* may be disposed in a vertical plane inclined with respect to the plane including the rotary axis of the drum 21. Also, as shown in FIG. 7, a radially inward section 458 connected to a radially outward section 457 of each of agitating blades 456 may extend over the entire length of the radially inward tread surface portion 32 of the upper surface of the helical balde 28. Alternatively, as shown in FIG. 8, each of agitating blades 556 may extend upwardly along the riser surface portion 29 from an area, adjacent to the riser surface portion 29, of the radially outward tread surface portion 31 so that top ends of the respective agitating blades 556 are substantially in flush with the radially inward tread surface portion 32.

The corrugated radially outward tread surface portion 231 shown in FIG. 3 and the respective agitating blades 356, 356*a*, 456 and 556 shown in FIGS. 4 to 8 promote the agitating action of the granular material on the helical blade 28 to enable the granular material to be positively flowed or fluidized, thereby activating the screening working.

Figure 9:
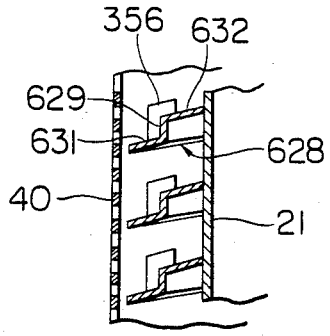
FIG. 9 is a view similar to FIG. 4, but showing another embodiment in which the helical blade has an upper surface inclined with respect to the horizontal plane.

In the foregoing embodiments, although the radially outward and inward tread surface portions 31 and 32 of the upper surface of the helical blade 28 have been illustrated and described as being substantially horizontal, radially outward and inward tread surface portions 631 and 632 connected to ech other by a vertical riser surface portion 629 of an upper surface of a helical blade 628 may, as shown in FIG. 9, be slightly inclined downwardly toward the screen member 40 with respect to the horizontal plane.

As described above, the vertical type screening machine for the granular material in accordance with the present invention is arranged such that the granular material to be screened is introduced into the top of the second chamber 42 and descends toward the bottom of the second chamber 42 during the rotation of the drum 21, and the remaining granular material within the second chamber 42 is discharged from the bottom of the second chamber 42. Such arrangement of the present invention enables the granular material to be screened, to be moved due to gravity, to thereby reduce a drive power required for drivingly rotating the rotary drum assembly 20 and improve the working efficiency.

Furthermore, the screening machine in accordance with the present invention is arranged such that the helical balde 28, 628 has the upper surface which is stepped so as to have at least one riser surface portion 29, 629 and adjacent radially outward and inward tread surface portions 31, 631 and 32, 632 connected to each other in a contiguous manner by the riser surface portion 29, 629, in cross-section in a plane including the rotary axis of the drum 21. The stepped upper surface of the helical blade 28, 628 enables the mass-state granular material layer on the helical blade 28, 628 to be subjected to a suitable centrifugal force, even if the thickness of the mass-state granular material layer changes or varies, to thereby provide a stable screening working.

What is claimed is:

1. A vertical type screening machine for granular material, comprising:

a housing having a peripheral wall;

a rotary drum assembly rotatably mounted within said housing, said drum assembly including a drum having a cylindrical circumferential surface and having a substantially vertical rotary axis, and a helical blade helically wound around the circumferential surface of said drum and secured thereto;

cylindrical screen means disposed between said housing and said rotary drum assembly in substantially concentric relation to said drum, said screen means cooperating with the peripheral wall of said housing to define therebetween a first chamber and cooperating with the cylindrical circumferential surface of said drum to define therebetween a second chamber;

means communicating with a top of said second chamber for allowing granular material to be screened to be supplied into said second chamber;

drive means drivingly connected to said rotary drum assembly for rotating the same to move the granular material supplied into said second chamber, radially outwardly toward said screen means, to hereby allow granular material having a relatively small size contained in the granular material to be screened, to be introduced into said first chamber through said screen means;

said helical blade being helically wound around the circumferential surface of said drum in such direction as to allow the granular material supplied into said second chamber to be moved toward a bottom of said second chamber due to gravity when said rotary drum assembly is rotated by said drive means and said helical blade having an upper surface thereof which is stepped so as to have at least one riser surface portion and adjacent radially outward and inward tread surface portions connected to each other in a contiguous manner by said riser surface portion, in cross-section in a plane including the rotary axis of said drum, said radially outward surface portion being located below said radially inward tread surface portion;

first outlet means communicating with a bottom of said first chamber for allowing the granular material of relatively small size to be discharged out of said first chamber; and second outlet means communicating with the bottom of said second chamber for allowing the remaining granular material within said second chamber to be discharged therefrom.

2. A screening machine defined in claim 1, further including agitating means provided on said helical blade for agitating the granular material on the upper surface of said helical blade upon the rotation of said rotary drum assembly.

3. A screening machine defined in claim 2, wherein said agitating means comprises said radially outward tread surface portion of the upper surface of said helical blade, said radially outward tread surface portion being corrugated along said helical blade.

4. A screening machine defined in claim 2, wherein said agitating means comprises a plurality of agitating blades spaced from ech other along said helical blade and secured to the upper surface thereof.

5. A screening machine defined in claim 4, wherein each of said agitating blades extends upwardly from said radially outward tread surface portion along said riser surface portion of the upper surface of said helical blade.

6. A screening machine defined in claim 4, wherein each of said agitating blades comprises a radially outward section extending upwardly from said radially outward tread surface portion along said riser surface portion beyond said radially inward tread surface portion of the upper surface of said helical blade, and a radially inward section extending upwardly from said radailly inward tread surface portion and integrally connected to said radially outward section of said agitating blade 7. A screening machine defined in claim 6, wherein said radially inward section of each of said agitating blades extends over the entire length of said radially inward tread surface porton of the upper surface of said helical blade.

8. A screening machine defined in any one of claims 5–7, wherein each of said agitating blades is disposed in the plane including the rotary axis of said drum.

9. A screening machine defined in any one of claims 5–7, wherein each of said agitating blades is disposed in a vertical plane inclined with respect to the plane including the rotary axis of said drum.

10. A screening machine defined in claim 2, wherein said radially outward and inward tread surface portions of the upper surface of said helical blade are slightly inclined downwardly toward said screen means with respect to a horizontal plane.

11. A screening machine defined in claim 2, wherein said radially outward and inward tread surface portions of the upper surface of said helical blade are substantially horizontal.

12. A vertical type screening machine for granular material, comprising:

a housing having a peripheral wall;

a rotary drum assembly rotatably mounted within said housing, said drum assembly including a drum having a cylindrical circumferential surface and having a substantially vertical rotary axis, and a helical blade helically wound around the circumferential surface of said drum and secured thereto;

cylindrical screen means disposed between said housing and said rotary drum assembly in substantially concentric relation to said drum, said screen means cooperating with the periphery wall of said housing to define therebetween a first chamber and cooperating with the cylindrical circumferential surface of said drum to define therebetween a second chamber;

inlet means communicating with said second chamber for allowing granular material to be screened to be supplied into said second chamber;

drive means drivingly connected to said rotary drum assembly for rotating the same to move the granular material supplied into said second chamber, radially outwardly towards said screen means, to thereby allow granular material having a relatively small size contained in the granular material to be screened, to be introduced into said first chamber through said screen means;

first outlet means communicating with said first chamber for allowing the granular material of relatively small size to be discharged out of said first chamber;

second outlet means communicating with said second chamber for allowing the remaining granular material within said second chamber to be discharged therefrom; and said helical blade having an upper surface thereof which is stepped so as to have at least one riser surface portion and adjacent redially outward and inward tread surface portions connected to each other in a contiguous manner by said riser surface portion, in cross-section in a plane including the rotary axis of said drum, said radially outward tread surface portion being located below said radially inward tread surface portion.

13. A screening machine defined in claim 12, further including agitating means provided on said helical blade for agitating the granular material on the upper surface of said helical blade upon the rotation of said rotary drum assembly.

14. A screening machine defined in claim 13, wherein said agitating means comprises said radially outward tread surface portion of the upper surface of said helical blade, said radially outward tread surface portion being corrugated along said helical blade.

15. A screening machine defined in claim 13, wherein said agitating means comprises a plurality of agitating blades spaced from each other along said helical blade and secured to the upper surface thereof.

16. A screening machine defined in claim 15, wherein each of said agitating blades extends upwardly from said radially outward tread surface portion along said riser surface portion of the upper surface of said helical blade.

17. A screening machine defined in claim 15, wherein each of said agitating blades comprises a radially outward section extending upwardly from said radially outward tread surface portion along said riser surface portion beyond said radially inward tread surface portion of the upper surface of said helical blade, and a radially inward section extending upwardly from said radially inward tread surface portion and integrally connected to said radially outward section of said agitating blade 18. A screening machine defined in claim 17, wherein said radially inward section of each of said agitating blades extends over the entire length of said radially inward tread surface portion of the upper surface of said helical blade.

19. A screening machine defined in any one of claims 16–18, wherein each of said agitating blades is disposed in the plane including the rotary axis of said drum.

20. A screening machine defined in any one of claims 16–18, wherein each of said agitating blades is disposed in a vertical plane inclined with respect to the plane including the rotary axis of said drum.

21. A screening machine defined in claim 13, wherein said radially outward and inward tread surface portions of the upper surface of said helical blade are slightly inclined downwardly toward said screen means with respect to a horizontal plane.

22. A screening machine defined in claim 13, wherein said radially outward and inward tread surface portions of the upper surface of said helical balde are substantially horizontal.

23. A screening machine defined in claim 13, wherein said screen means is rotatably mounted within said housing, and said drive means is drivingly connected to said rotary drum assembly and said screen means through gearing means to rotate said rotary drum assembly and said screen means in the same direction, but at such different speeds that said rotary drum assembly is rotated at a rotational speed higher than that at which said screen means is rotated.

* * * * *